US005761931A

United States Patent [19]

Lonati et al.

[11] Patent Number: 5,761,931

[45] Date of Patent: Jun. 9, 1998

[54] SINGLE-CYLINDER CIRCULAR KNITTING MACHINE

[75] Inventors: Francesco Lonati; Tiberio Lonati; Ettore Lonati; Fausto Lonati, all of Brescia, Italy

[73] Assignee: Matec S.r.l., Scandicci, Italy

[21] Appl. No.: 769,171

[22] Filed: Dec. 18, 1996

[30] Foreign Application Priority Data

Jan. 8, 1996 [IT] Italy ..... MI96A0020

[51] Int. Cl.[6] ..... D04B 9/56

[52] U.S. Cl. ..... 66/148; 66/58

[58] Field of Search ..... 66/14, 43, 48, 66/59, 148

[56] References Cited

U.S. PATENT DOCUMENTS 5,570,591 11/1996 Frullini et al. ..... 66/58

5,617,744 4/1997 Conti ..... 66/148

FOREIGN PATENT DOCUMENTS 1 346 518 11/1963 France .

2 033 473 12/1970 France .

16 35 992 7/1971 Germany .

*Primary Examiner*—John J. Calvert

*Attorney, Agent, or Firm*—Guido Modiano; Albert Josif

[57] ABSTRACT

A single-cylinder circular knitting machine, including a needle cylinder and a circular plate that is arranged above the needle cylinder and coaxially thereto. The circular plate is constituted by two portions, one of which can rotate with respect to the other about a diametrical axis of the circular plate. An actuation device is also provided which acts on command on the portion of the circular plate that can rotate with respect to the other one, in order to move it from a first position, in which it is co-planar with respect to the other portion, to a second position, in which it is arranged so as to face the other portion from below, or vice versa.

20 Claims, 4 Drawing Sheets

1
10
25a
15a
11
9
8
6
7
16
15
15b
17
18
23
5
30
30
26
26
5b
12
14
13
20
5a
25
4
4
3
3
2a
2

SINGLE-CYLINDER CIRCULAR KNITTING MACHINE

BACKGROUND OF THE INVENTION

The present invention relates to a single-cylinder circular knitting machine, particularly useful for knitting knitwear, hosiery items, or the like, with highly versatile use.

It is known that single-cylinder circular knitting machines are generally provided, above the needle cylinder, with a circular plate constituted by a substantially disk-shaped element that coaxially faces the upper end of the needle cylinder in an upward region. The circular plate has a plurality of radial grooves, and a hook is arranged inside each one of said grooves; the hook can be actuated along the corresponding groove so that its tip protrudes from the circular plate between two contiguous needles of the needle cylinder in order to take up or retain loops of knitting formed by the needles of the needle cylinder.

This possibility is used, for example, to produce hems at a longitudinal end of the tubular product that is produced with this type of machine.

For example, the hooks of the circular plate are activated when, at the beginning of the knitting of a hosiery item in single-cylinder circular knitting machines for knitwear or hosiery items, one wishes to produce the so-called top or tubular hem at the upper end of the leg of the hosiery item.

In practice, the hooks are made to protrude from the circular plate so that some loops of knitting formed by the needles are retained by the hooks and are then returned to the needles after said needles have knitted a few rows of knitting, so as to obtain a hem, i.e., a tubular border.

In some kinds of single-cylinder knitting machines for knitting knitwear or hosiery items, for example in the machine described in German patent no. 1635992, as an alternative to the circular plate there is an element that can be likened to a circular plate half, since it extends over substantially 180° around the axis of the needle cylinder; this element car rotate on command about a diametrical axis of the needle cylinder, so that it can alternatively face one half of the needle cylinder and the opposite half.

In this case, too, the circular plate half has a plurality of radial grooves, each of which accommodates a hook and a complementary hook, which are actuated so as to pick up and retain the loops formed by the needles of the needle cylinder half faced by the circular plate half.

After taking up the loops formed by the needles of one half of the needle cylinder, the circular plate half is turned over about the diametrical axis and is arranged so as to face the other half of the needle cylinder, where the hooks and the complementary hooks are actuated so as to release the loops taken up earlier at the needles of the other half of the needle cylinder.

This possibility of transferring the loons from the needles of one half of the needle cylinder to the other half of the needle cylinder, which can be achieved by turning over the circular plate half about a diametrical axis, is advantageously used to close one end of the tubular product that is produced with this type of machine, for example to form hosiery items in which the toe is closed directly on the circular machine used to produce them.

The adoption of a circular plate half to perform processes that allow to close one end of the tubular product that can be produced with single-cylinder circular knitting machines currently prevents the use of a conventional circular plate and therefore does not allow to produce tubular products with a hem on the machine.

In practice, with a single-cylinder circular knitting machine for producing hosiery items of the type described in German patent no. 1635992, it is possible to obtain hosiery items whose toe is closed directly on the machine used to produce them, but on the other hand it is not possible to form a hem at the opposite end of the hosiery item.

SUMMARY OF THE INVENTION

One aim of the present invention is to solve the above described problem by providing a single-cylinder circular knitting machine that allows, according to the requirements, to produce a hem or tubular border at one end of the tubular product or to transfer the loops from the needles of one half of the needle cylinder to the needles of the other half of the needle cylinder in order to close the opposite end of the tubular product directly on the machine used for its production.

An object of the invention is to provide a machine that in addition to allowing to close one end of the tubular product also allows to perform processes that can typically be achieved with single-cylinder circular knitting machines having a conventional circular plate.

Another object of the invention is to provide a machine that can have competitive production costs.

In accordance with one aspect of the invention, there is provided a single-cylinder circular knitting machine which comprises a needle cylinder and a circular plate that is arranged above the needle cylinder and coaxially thereto. The circular plate is constituted by two portions, one of which can rotate with respect to the other about a diametrical axis of the circular plate, and actuation means being provided that act on command on the first portion of the circular plate to move it from a first position, in which it is co-planar with respect to the other portion, to a second position, in which it is arranged so as to face the other portion from below, or vice versa.

BRIEF DESCRIPTION OF THE DRAWINGS

All of the technical characteristics and advantages of the invention will become apparent from the following detailed description of some preferred but not exclusive embodiments of a knitting machine according to the invention, described and illustrated in the accompanying drawings only by way of non-limitative example, wherein.

DESCRIPTION OF THE PREFERRED EMBODIMENTS

Figure 1:
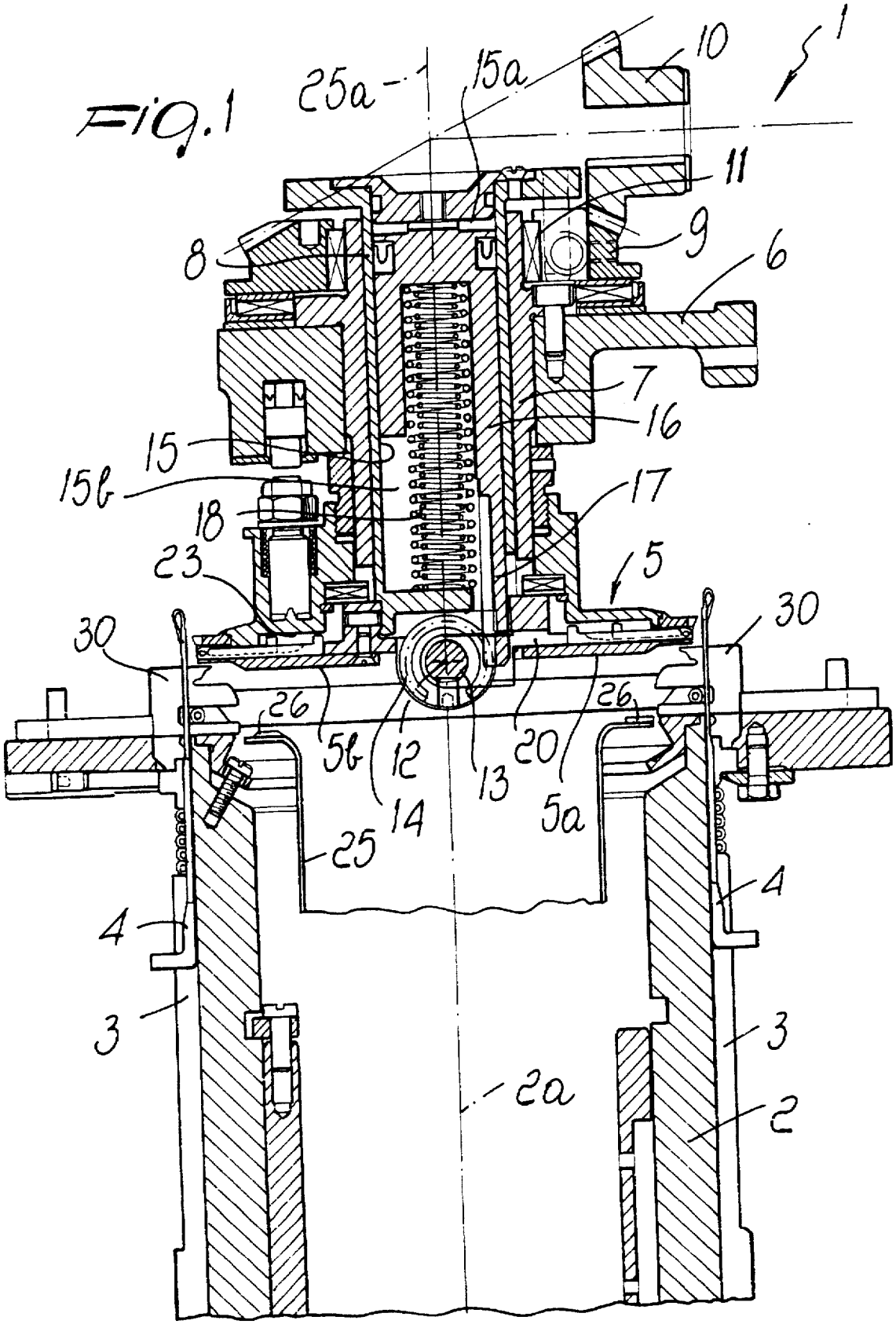
FIG. 1 is an axial sectional elevation view of a single-cylinder circular knitting machine, according to one preferred aspect of the invention, with two circular plate portions in the co-planar position.

With reference to the above figures, a circular knitting machine according to one preferred aspect of the invention, generally designated by the reference numeral 1, comprises, in a per se known manner, a needle cylinder 2 having a vertical axis 2*a* and, on its skirt, a plurality of grooves 3, each of which accommodates a needle 4 that can be actuated in a known manner along the corresponding groove 3 to form knitting.

A circular plate 5 is arranged above the needle cylinder 2 and is supported by a portion 6 of the load-bearing structure of the machine, such that the plate 5 can rotate about its own axis 25*a*, which substantially coincides with the axis 2*a* of the needle cylinder 2.

More particularly, a first tubular body 7 is fixed to the portion 6 and its axis substantially coincides with the axis 25*a*; the tubular body 7 internally rotatably supports a supporting structure 8 that is constituted by a second tubular body that is arranged inside the first tubular body 7 and coaxially thereto.

The rotatable supporting structure 8 is fixed, at its upper end, to a bevel gear 9 that meshes with a bevel gear 10 that can be actuated so as to turn the supporting structure 8 about the axis 25*a*.

The bevel gear 9 is supported by the first tubular body 7 by virtue of the interposition of a bearing 11.

The supporting structure 8 supports the circular plate 5 at its lower end, i.e., at the end directed towards the needle cylinder 2.

According to the invention, the circular plate 5 is constituted by two portions 5*a* and 5*b*, each of which substantially corresponds to half of the circular plate 5: the portion 5*a* can rotate with respect to the other portion 5*b* about a diametrical axis 12 of the circular plate.

More particularly, the portion 5*b* is appropriately fixed to the lower end of the supporting structure 8, whereas the portion 5*a* is fixed to a pivot 13 whose axis coincides with the axis 12 and on which a gear 14 is keyed.

A cylindrical chamber 15 is formed coaxially inside the supporting structure 8 and slidingly accommodates a piston 16, a portion of which is connected to a rack 17 that meshes with the gear 14.

The piston 16 divides the cylindrical chamber 15 into two parts, i.e., a part 15*a* that can be connected on command to a pressurized fluid and a part 15*b* inside which there are one or more springs 18 that contrast the movement of the piston 16 caused by the introduction of a pressurized fluid in the part 15*a* of the chamber 15.

In practice, the cylindrical chamber 15, the piston 16, and the spring 18 constitute a single-action fluid-actuated cylinder which, by means of the rack 17, causes the partial rotation of the portion 5*a* of the circular plate 5 about the diametrical axis 12.

By virtue of the actuation of said fluid-actuated cylinder, it is possible to cause the portion 5*a* of the circular plate 5 to pass from a first position, in which it is co-planar with respect to the other portion 5*b*, as shown in particular in FIG. 1, to a second position, in which it faces the portion 5*b* from below, as shown in particular in FIG. 2.

A plurality of radial grooves 20 is formed inside the circular plate 5, and a hook 21 and a complementary hook 22 are slidingly accommodated inside each one of said grooves.

The hook 21 is provided with a point 21*a* that is directed away from the bottom of the corresponding groove inside which it is accommodated and with a heel 21*b* that protrudes from said groove.

The complementary hook 22 is also provided with a heel 22*b* that protrudes from the corresponding groove of the circular plate and with a point 22*a* that is directed toward the bottom of the corresponding groove of the circular plate, inside which it is accommodated together with the hook 21.

The hooks 21 and 22 can be slidingly actuated along the corresponding grooves 20 of the circular plate by means of appropriate cams 23 that are connected to the portion 6 of the load-bearing structure of the machine and face the upper face of the circular plate 5, i.e., the face from which the heels 21*b* and 22*b* protrude when the two portions 5*a* and 5*b* of the circular plate are co-planar.

The cams 23 are provided in such a manner as to cause the radial movement of the hooks 21 and of the complementary hooks 22 as a consequence of the rotary actuation of the circular plate 5 with respect to the cams 23, which as mentioned are mounted on the portion 6 of the load-bearing structure of the machine.

Figure 2:
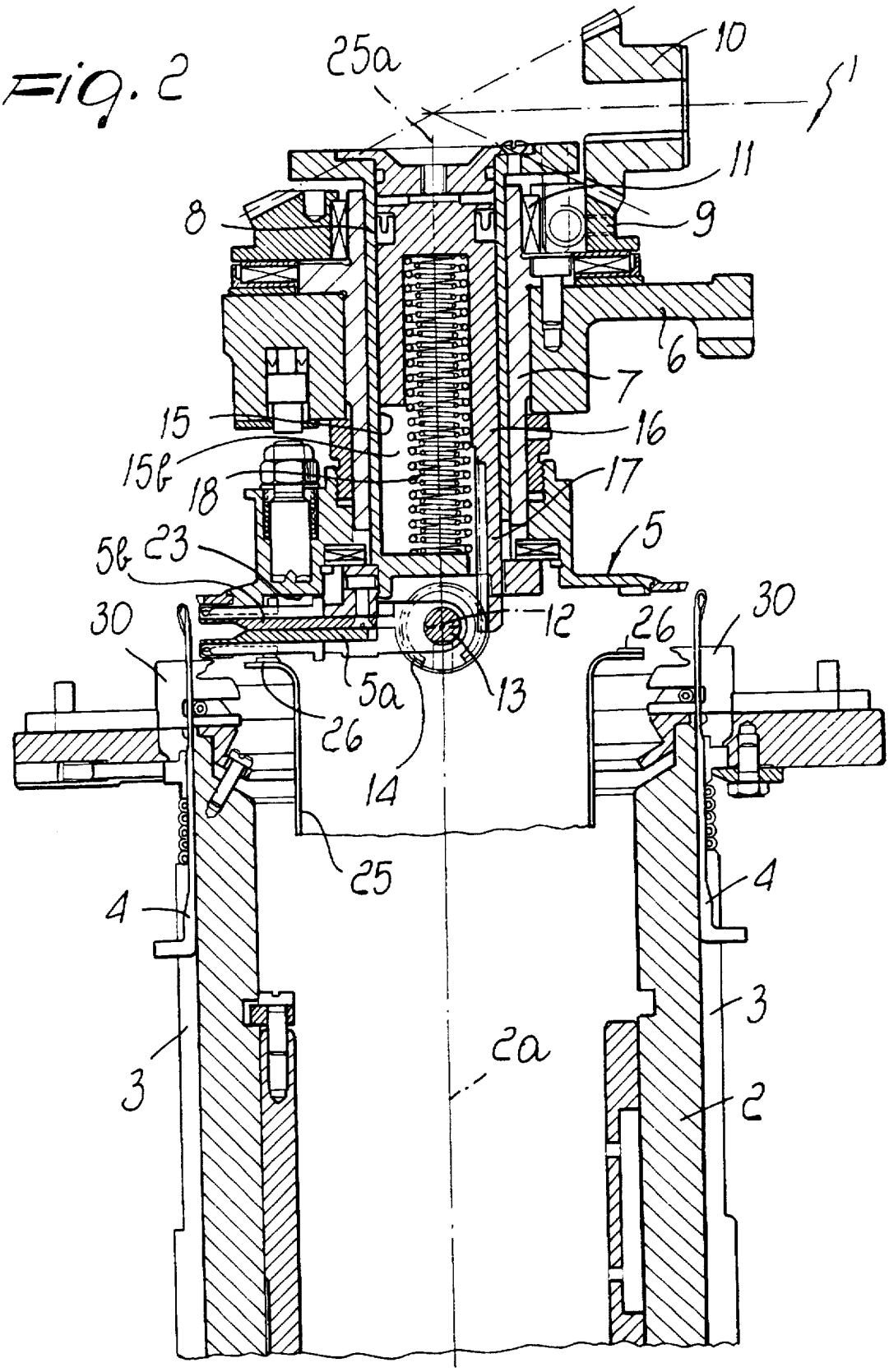
FIG. 2 is a sectional elevation view of the machine, taken similarly to FIG. 1, with one portion of the circular plate arranged so as to face the other portion from below.
Figure 3:
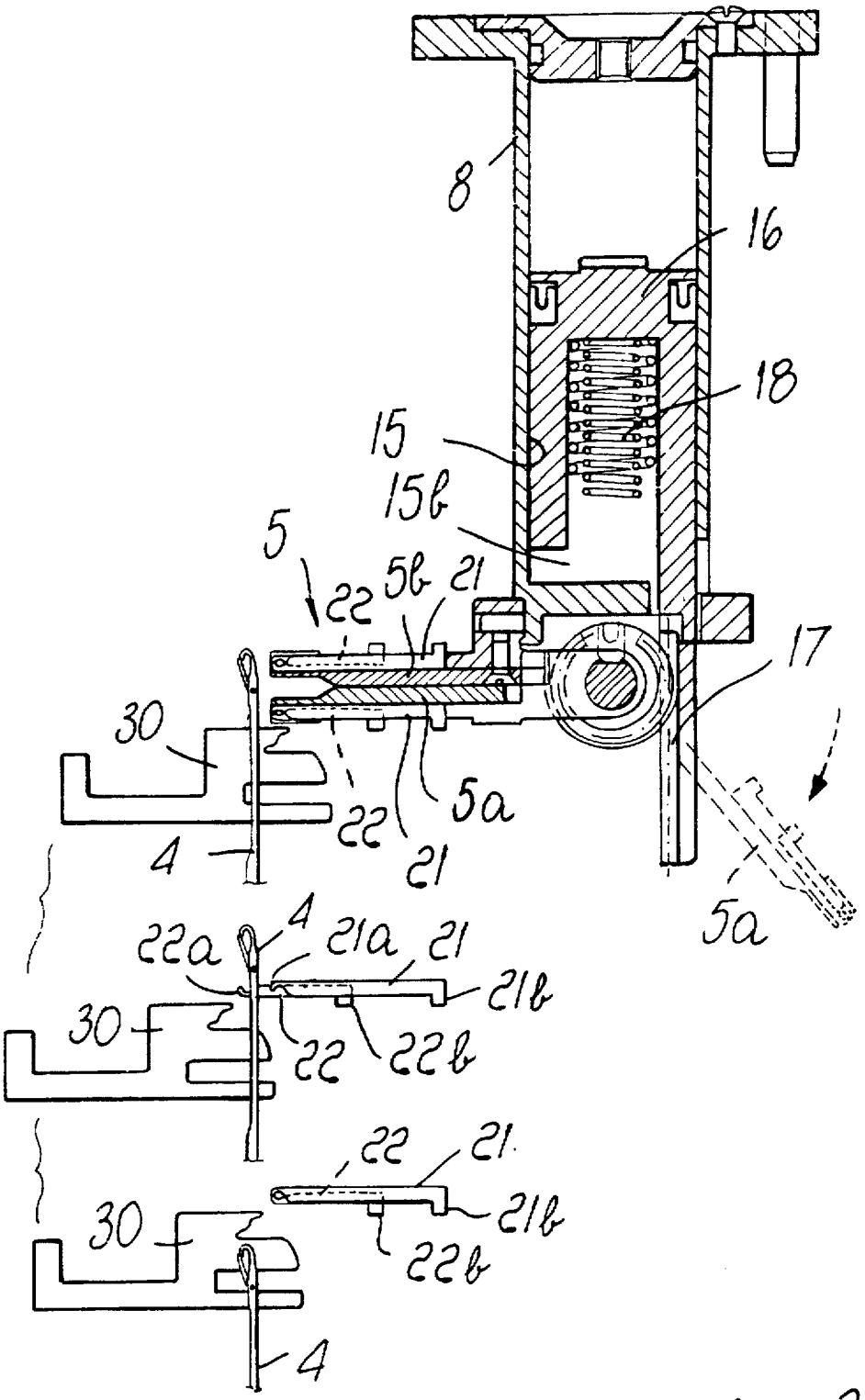
FIG. 3 is a schematic view of the operating sequence at the beginning of the transfer of the loops from the needles of one half of the needle cylinder to the needles of the other half.

Conveniently, cams 26 are provided on the upper end of a suction duct 25, which is arranged in a conventional manner inside the needle cylinder; the cams 26 can engage the heels 22*b* of the complementary hooks 22 of the portion 5*a* of the circular plate when the portion 5*a* faces the portion 5*b* from below, as shown in FIGS. 2 and 3, in order to allow the complementary hooks 22 to take up the loops from the needles of one half of the needle cylinder.

The circular plate 5 is also movable on command, in a per se Known manner, along the axis 2*a* of the needle cylinder 2 to allow the rotation of the portion 5*a* of the circular plate about the axis 12.

In practice, the circular plate of the machine according to the invention, being provided in two halves, one of which can rotate with respect to the other one about diametrical axis, can be used, according to the requirements, as a conventional circular plate or as an element for transferring the loops from the needles of one half of the needle cylinder to the needles of the other half of the needle cylinder, like the circular plate half described in German patent no. 1635992.

Figure 4:
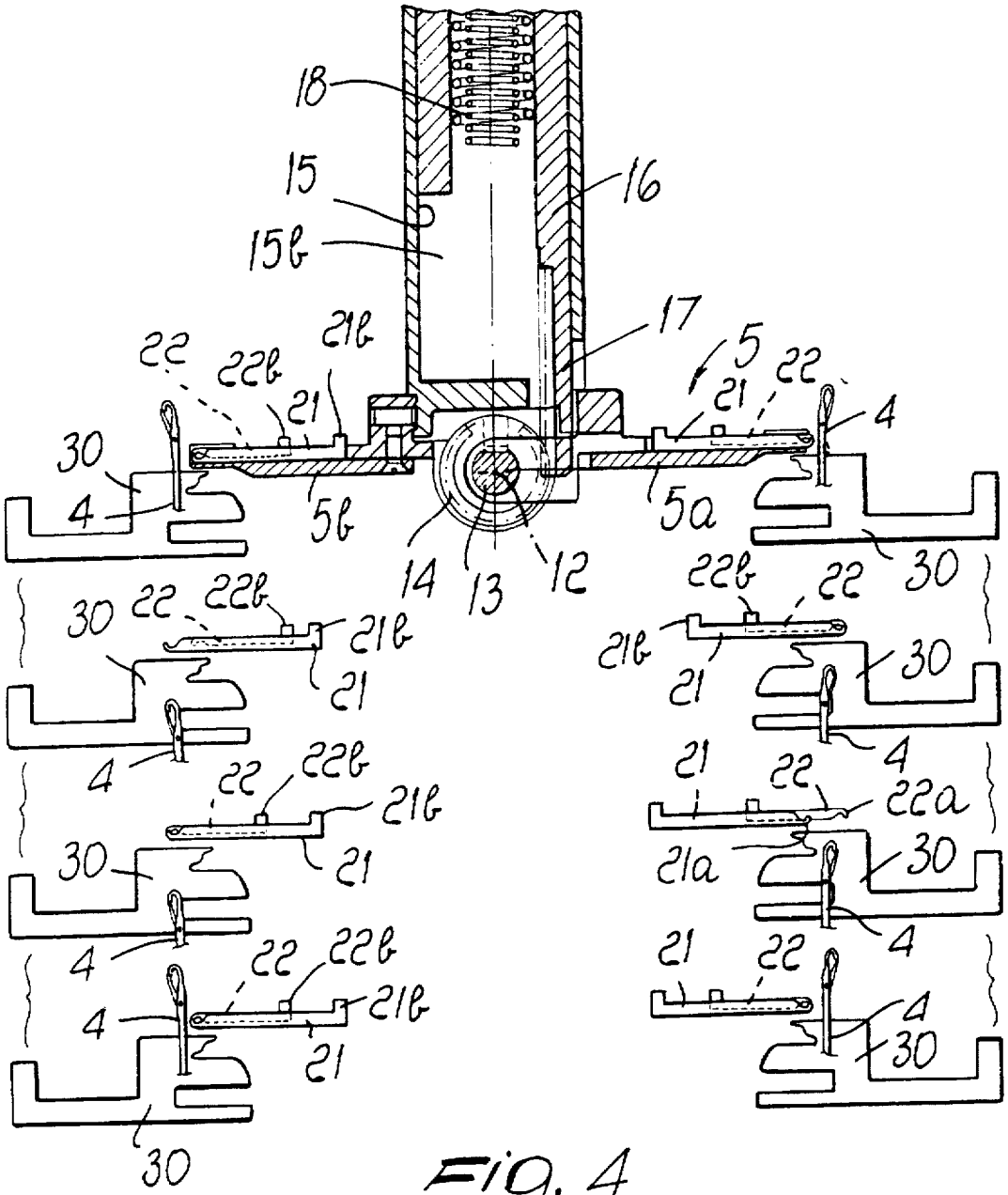
FIG. 4 is a schematic view of the operating sequence for forming a conventional hem with the machine of the preceding figures.
Figure 5:
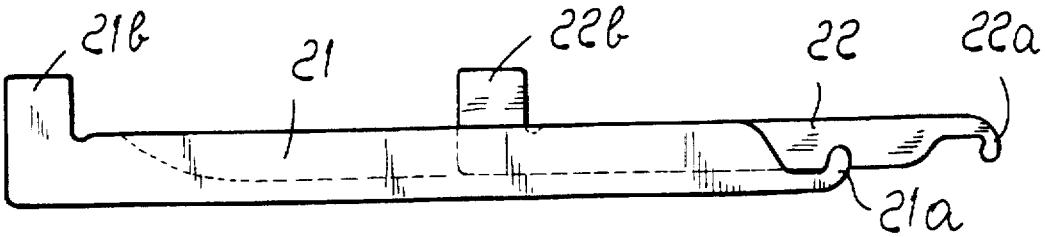
FIG. 5 is a lateral elevation view of a hook and of a complementary hook of the machine of the preceding figures.

As shown in particular in FIG. 4, it is possible to actuate the hooks 21 and the complementary hooks 22 so that during the formation of the border or a tubular product the hooks 21 engage the loops formed by the needles of the machine so as to retain them and then return these loops to the needles, so as to knit them in with rows of knitting formed subsequently in order to produce a hem, or, as shown in particular in FIG. 3, it is possible to use the hooks and the complementary hooks of the portion 5*a* of the circular plate to transfer the loops from one half of the needle cylinder to the other half, in order to allow to produce hosiery items whose toe is closed directly on the machine used to produce them, according to conventional processes.

For the sake of completeness in description, it should be noted that the sinkers for casting off the knitting have also been shown in the various figures and are designated by the reference numeral 30.

In practice it has been observed that the machine according to the invention fully achieves the intended aim, since it is capable of performing both processes that require the transfer of the loops from the needles of one half of the needle cylinder to the needles of the other half of the needle cylinder and processes that require the use of a circular plate, such as for example hems at one end of the product.

The machine thus conceived is susceptible of numerous modifications and variations, all of which are within the scope of the inventive concept; all the details may furthermore be replaced with other technically equivalent elements.

In practice, the materials employed, as well as the dimensions, may be any according to the requirements and the state of the art.

What is claimed is:

1. Single-cylinder circular knitting machine, comprising a needle cylinder and a circular plate arranged above the needle cylinder and coaxially thereto, said circular plate being constructed in two portions, one of which is rotatable with respect to the other about a diametrical axis of the circular plate, an actuation device being provided for acting on command on the first portion of the circular plate to move the first portion between a first position, in which the portion is co-planar with respect to the other portion, and a second position, in which the first portion is arranged in a position which is parallel with and beneath the other portion.

2. Machine according to claim 1, wherein each one of said two portions constitutes half of the circular plate.

3. Machine according to claim 1, wherein said circular plate is mounted on a supporting structure supported by a load-bearing structure of the machine such that said supporting structure is rotatable about an axis of the circular plate.

4. Machine according to claim 3, wherein said actuation device comprises a fluid-actuated cylinder acting on command on said first portion of the circular plate to rotate said first portion about said diametrical axis with respect to the other portion of the circular plate.

5. Machine according to claim 4, wherein said other portion of the circular plate is fixed to said supporting structure.

6. Machine according to claim 5, wherein said first portion of the circular plate is fixed to a pivot supported by said supporting structure so that the first portion is rotatable about the axis that forms said diametrical axis, a gear being keyed on said pivot and meshing with a rack connected to the piston of said fluid-actuated cylinder.

7. Machine according to claim 6, wherein said fluid-actuated cylinder is formed in said supporting structure and is arranged so that an axis of the cylinder substantially coincides with the axis of the circular plate.

8. Machine according to claim 1, wherein a plurality of radial grooves is formed in said circular plate, each groove accommodating at least one hook and one complementary hook slideable on command along the corresponding groove of the circular plate so that tips of the hooks protrude radially from the circular plate or so that the hooks retract into the corresponding groove to take up or release loops of knitting formed by needles of the needle cylinder or to transfer the loops of knitting from the needles of one half of the needle cylinder to the needles of the other half of the needle cylinder.

9. Machine according to claim 8, wherein said hooks and said complementary hooks are provided with heels which protrude from the corresponding groove of the circular plate and are engageable with first actuation cams mounted on a portion of the load-bearing structure of the machine supporting said supporting structure.

10. Machine according to claim 9, further comprising second actuation cams engageable with the heels of the complementary hooks arranged on said first portion of the circular plate facing the other portion of the circular plate from below.

11. Machine according to claim 10, wherein said second actuation cams are connected to an upper end of a product suction duct beneath and facing the circular plate.

12. Machine according to claim 1, wherein said circular plate is movable on command along the axis of the needle cylinder.

13. Single-cylinder circular knitting machine, comprising a needle cylinder and a circular plate arranged above the needle cylinder and coaxially thereto, said circular plate being constructed in two portions, one of which is rotatable with respect to the other about a diametrical axis of the circular plate such that the first portion is movable between a first position, in which the portion is co-planar with respect to the other portion, and a second position, in which the first portion is arranged in a position which is parallel with and beneath the other portion.

14. Machine according to claim 13, wherein each one of said two portions constitute s half of the circular plate.

15. Machine according to claim 13, wherein said circular plate is mounted on a supporting structure supported by a load-bearing structure of the machine such that said supporting structure is rotatable about an axis of the circular plate.

16. Machine according to claim 15, wherein said other portion of the circular plate is fixed to said supporting structure.

17. Machine according to claim 16 further comprising an actuation device for acting on command on the first portion of the circular plate to move the first portion between said first and second positions, and wherein said actuation device comprises a fluid-actuated cylinder acting on command on said first portion of the circular plate to rotate said first portion about said diametrical axis with respect to the other portion of the circular plate, and wherein said first portion of the circular plate is fixed to a pivot supported by said supporting structure so that the first portion is rotatable about the axis that forms said diametrical axis, a gear being keyed on said pivot and meshing with a rack connected to the piston of said fluid-actuated cylinder, and wherein said fluid-actuated cylinder is formed in said supporting structure and is arranged so that an axis of the cylinder substantially coincides with the axis of the circular plate.

18. Machine according to claim 13, wherein a plurality of radial grooves is formed in said circular plate, each groove accommodating at least one hook and one complementary hook slideable on command along the corresponding groove of the circular plate so that tips of the hooks protrude radially from the circular plate or so that the hooks retract into the corresponding groove to take up or release loops of knitting formed by needles of the needle cylinder or to transfer the loops of knitting from the needles of one half of the needle cylinder to the needles of the other half of the needle cylinder, and wherein said hooks and said complementary hooks are provided with heels which protrude from the corresponding groove of the circular plate and are engageable with first actuation cams mounted on a portion of the load-bearing structure of the machine supporting said supporting structure.

19. Machine according to claim 18, further comprising second actuation cams engageable with the heels of the complementary hooks arranged on said first portion of the circular plate facing the other portion of the circular plate from below, and wherein said second actuation cams are connected to an upper end of a product suction duct beneath and facing the circular plate.

20. Machine according to claim 13, wherein said cicircular plate is movable on command along the axis of the needle cylinder.

* * * * *